US009115872B2

(12) United States Patent
Cheng et al.

(10) Patent No.: US 9,115,872 B2
(45) Date of Patent: Aug. 25, 2015

(54) LED ILLUMINATION DEVICE

(75) Inventors: Shun-Chung Cheng, Taitung County (TW); Chih-Huang Wang, Taoyuan County (TW); Chang-Ming Cheng, New Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 262 days.

(21) Appl. No.: 13/237,926

(22) Filed: Sep. 20, 2011

(65) Prior Publication Data

US 2012/0162993 A1 Jun. 28, 2012

(30) Foreign Application Priority Data

Dec. 27, 2010 (CN) ..... 2010 1 0607098

(51) Int. Cl.

| | |
|---|---|
| ***F21V 9/00*** | (2006.01) |
| ***F21V 17/02*** | (2006.01) |
| ***F21S 10/02*** | (2006.01) |
| ***F21V 9/10*** | (2006.01) |
| ***F21V 14/06*** | (2006.01) |
| ***F21V 29/76*** | (2015.01) |
| *F21Y 101/02* | (2006.01) |

(52) U.S. Cl.

CPC ..... *F21V 17/02* (2013.01); *F21S 10/02* (2013.01); *F21V 9/10* (2013.01); *F21V 14/06* (2013.01); *F21V 29/767* (2015.01); *F21Y 2101/02* (2013.01)

(58) Field of Classification Search

CPC ..... F21S 2/00; F21V 1/00; F21V 15/00; F21Y 2101/00

USPC ..... 362/293, 84, 230–235, 294, 373, 284

See application file for complete search history.

(56) References Cited

U.S. PATENT DOCUMENTS

| | | | | |
|---|---|---|---|---|
| 6,755,554 | B2 * | 6/2004 | Ohmae et al. | 362/293 |
| 6,817,737 | B2 * | 11/2004 | Romano et al. | 362/293 |
| 7,984,999 | B2 * | 7/2011 | Harbers et al. | 362/231 |
| 8,523,924 | B2 | 9/2013 | Meyer et al. | |

* cited by examiner

*Primary Examiner* — Anh Mai
*Assistant Examiner* — Jessica M Apenteng
(74) *Attorney, Agent, or Firm* — Li & Cai Intellectual Property (USA) Office

(57) ABSTRACT

A lighting device includes a base, a light source, an optical color wheel, and a lens. The base has a plurality of fins for heat dissipation. The light source is disposed in the base, and the optical color wheel is disposed above the light source and in contact with the base. The lens is movably disposed on the base. The Light from the light source passes through the optical color wheel to form colored light. The colored light passes through the lens to form a light beam. Heat generated by the light source and the optical color wheel is dissipated by the fins.

17 Claims, 4 Drawing Sheets

LED ILLUMINATION DEVICE

BACKGROUND OF THE INVENTION

1. Field of the Invention

The instant disclosure relates to a lighting device; more particularly, to a lighting device having a heat dissipating structure capable of alleviating heat accumulation for both the light source and the optical color wheel thereof.

2. Description of Related Art

For conventional lighting devices, heat dissipation is designed primarily for light-emitting diode (LED) to reduce its working temperature. However, heat around the optical color wheel for light mixing often cannot be dissipated effectively. Also, the light projection angle is fixed for conventional lighting devices, meaning the light pattern is restricted. In use, such lighting devices are limited in scope, and the color temperature of the light are fixed also.

Hence, to address the above issues, the inventor presents the following solution.

SUMMARY OF THE INVENTION

The instant disclosure encompasses a lighting device, which can dissipate heat generated by a light source and an optical color wheel.

In one aspect, since the optical color wheel is in rotatable contact with the base, the fins of the base can dissipate heat generated by the optical color wheel in addition to the light source. Besides, the lens is movably disposed on the base, the light projection angle can be adjusted accordingly. Also, a plurality of colored petals can be disposed on the optical color wheel. When the optical color wheel rotates, light passes through different color petals to provide multiple colors of light. Hence, the color temperature of the light for the lighting device can be adjusted.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENT

Figure 1:
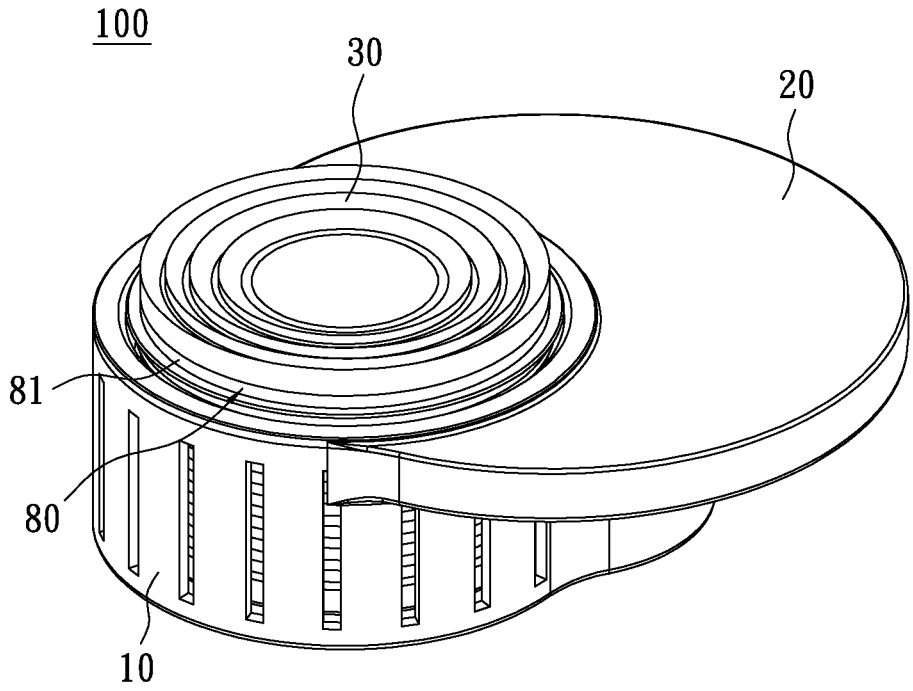
FIG. 1 is a perspective view of a lighting device for the instant disclosure.
Figure 2:
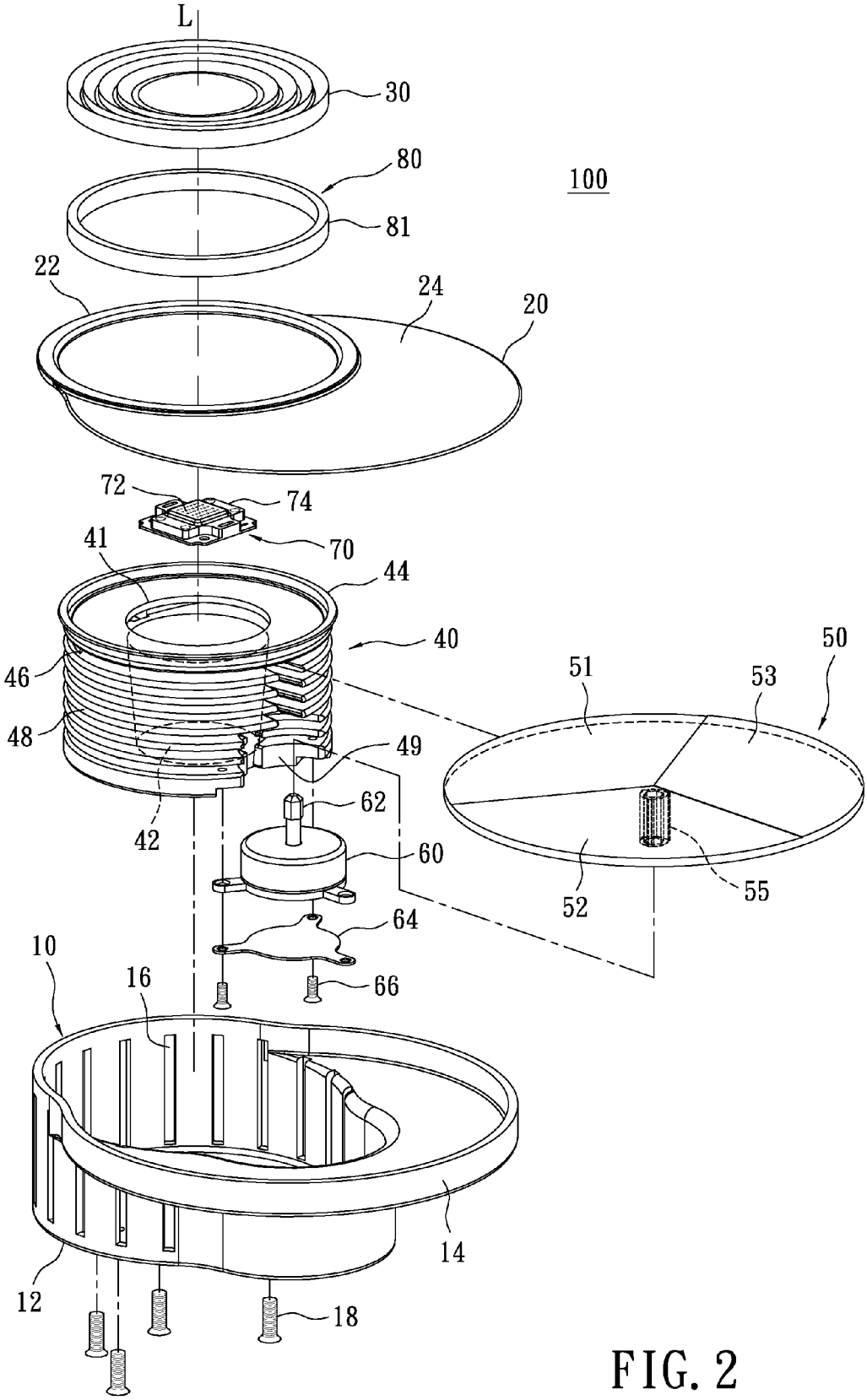
FIG. 2 is an exploded view of the lighting device for the instant disclosure.

Please refer to FIGS. 1 and 2, which show a lighting device 100 of the instant disclosure. The lighting device 100 comprises a holder 10, a cover 20, a lens 30, a base 40, an optical color wheel 50, a motor 60, and a light source 70.

The holder 10 receives the base 40 therein. The base 40 has a plurality of protruded fins 48 for heat dissipation. The light source 70 is received inside the base 40, and the optical color wheel 50 is disposed over the light source 70 and rotatably in contact with the base 40. The lens 30 is movably disposed over the base 40 and the optical color wheel 50. An opening 41 is formed centrally on the base 40 to permit passage of light emitted from the light source 70. A central point of the opening 41 is located on an optical axis defined by the lens 30. The optical color wheel 50 is disposed above the opening 41. Through the opening 41, light from the light source 70 pass through the optical color wheel 50 to provide the colored light. The colored light then passes through the lens 30 to form a light beam. The lens 30 can move along an optical axis L to increase or decrease the distance between the lens 30 and the light source 70, thereby changing the light beam characteristics.

In use, heat is generated by the light source 70 for the lighting device 100. A coating, which could be made of wavelength conversion (modifying) material, can be coated on the optical color wheel 50. The light emitted by the light source 70 excites the wavelength conversion material to generate the colored light. Also, as light from the light source 70 passes through the optical color wheel 50, the coating made of a wavelength conversion material (e.g. phosphor powder) coated on the optical color wheel 50 is excited to generate heat. For both conditions, the generated heat can be dissipated by the fins 48 of the base 40. Three different color petals 51, 52, 53 can be disposed on the optical color wheel 50. The optical color wheel 50 is mounted on a shaft 62 of the motor 60 offset from the optical axis L, so only a portion of the optical color wheel 50 is exposed at the opening 41. By controlling the rotation of the shaft 62 of the motor 60, the color petals 51, 52, 53 would rotate sequentially above the light source 70. When light from the light source 70 passes through different color petals 51, 52, 53, multiple colors of light are generated (e.g. a blue LED can excite yellow phosphor powder to produce a white light). Also, the rotational speed of the motor 60 can be controlled to perform light mixing. The base 40 and the optical color wheel 50 are received in the holder 10, wherein screws 18 are used to secure the base 40 to the holder 10. The cover 20 is disposed at the upper edge of the holder 10, combines with the base 40, and covers the optical color wheel 50. Detailed structural descriptions for each element are given below.

Figure 3:
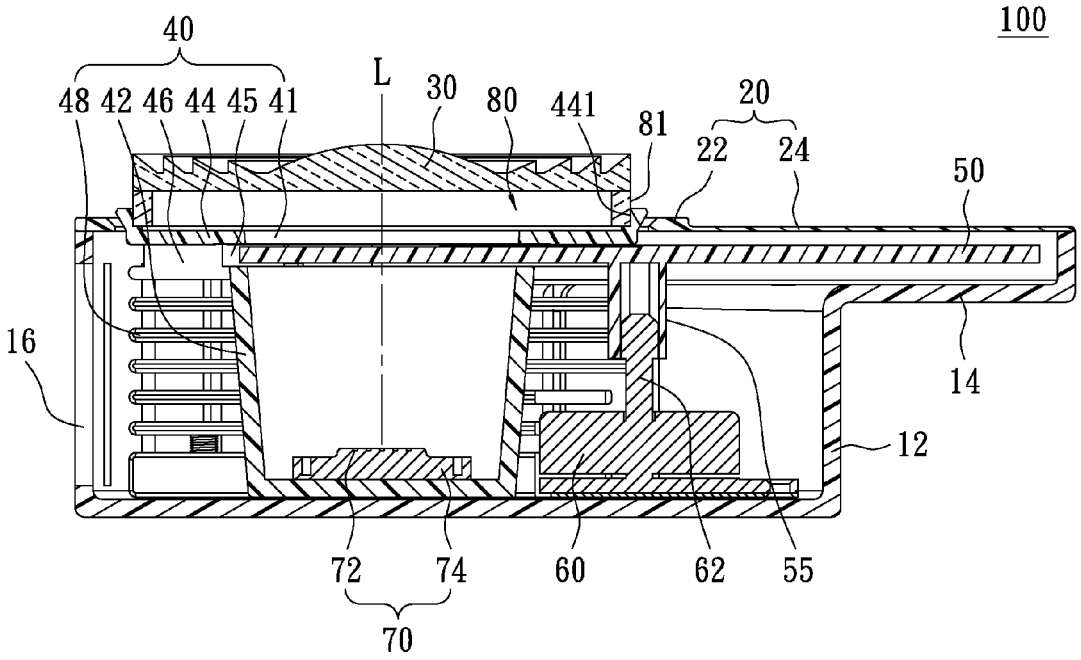
FIG. 3 is a sectional view of the lighting device for the instant disclosure.

Please refer to FIGS. 2 and 3. The base 40 includes a body 42, a support portion 44, and a connecting portion 46. The connecting portion 46 is connected to the body 42 and the support portion 44. A clearance 45 is formed by the connecting portion 46 between the body 42 and the support portion 44. The connecting portion 46 is connected to the body 42 and the support portion 44 partially. The unconnected portion thereof forms the clearance 45. The clearance 45 allows the base 40 to receive the optical color wheel 50 therein. The optical color wheel 50 can rotate within the clearance 45 and contact the support portion 44. For the instant disclosure, the body 42 is a hollow-cylinder shaped with a bottom board to form an inward-concaved structure. The light source 70 is disposed on the bottom board of the body 42 internally. The fins 48 of the base 40 are equally spaced on the outer surface of the body 42, wherein the fins 48 extend in forming an annular arrangement on the body 42. In other words, the fins 48 are parallel to the bottom board of the body 42 and form a plurality of annular structures parallel to each other on the outer surface of the base 40. The support portion 44 is disc-shaped, wherein the opening 41 is formed at the center thereof. The lens 30 is supported by the support portion 44 and a central point of the opening 41 is located on an optical axis defined by the lens 30. The lens 30 can move along the optical axis L (FIG. 3). A recess 49 is formed on the fins 48 in approximately corresponding to the connecting portion 46 to receive the motor 60 (as shown in FIG. 3, the connecting portion 46 and the motor 60 are arranged on opposing sides of the base 40). The shaft 62 of the motor 60 can also be received in the recess 49. The recess 49 is shaped for receiving the motor 60 and the shaft 62 connected to a collar 55 of the optical color wheel 50. The recess 49 is formed at one side of the fins 48, so the shaft 62 is also being disposed at one side of the fins 48. Meaning, the optical color wheel 50, which is connected to the shaft 62, is offset relative to the body 42. To transfer heat from the optical color wheel 50 to the base 40 for heat dissipation by the fins 48, the optical color wheel 50 may remain in contact with the bottom surface of the support portion 44 of the base 40. To enhance heat transfer efficiency, heat conducting material can be coated on the bottom surface of the support portion 44. In addition, spray coating, liquid coating, or press fit technique can be applied to distribute phosphor powders evenly on the optical color wheel 50. As the light from the light source 70 passes through the optical color wheel 50, the phosphor powders are excited to produce the colors light (multi-color light or white light), thus generating light with different color temperatures. The heat conducting material contacts the support portion 44 to transfer heat effectively from the optical color wheel 50 to the support portion 44. Heat is transferred to the fins 48 via the connecting portion 46 and the body 42. To enhance the heat transfer effect, the base 40 can be made of material with high thermal conductivity, such as copper or aluminum.

Please refer to FIG. 3. The lens 30 is arranged on a ring-shaped lens holder 80. The lens holder 80 is held up by the support portion 44 of the base 40. A first threaded portion (not shown) is formed on an inside edge 441 of the support portion 44. A second threaded portion (not shown) is formed correspondingly on an outside edge 81 of the lens holder 80. By threading the second thread portion into the first threaded portion or threading the second thread portion away from the first threaded portion, the lens 30 supported by the support portion 44 can move along the optical axis L, thereby changing the light beam coming out of the lens 30. For the instant disclosure, although the lens 30 is moved along the optical axis L by threading the first and second threaded portion, the method is not limited thereto. Any structure that allows the lens 30 to move relative to the support portion 44 is applicable. Also, for the instant disclosure, although the lens 30 is a Fresnel type lens, the lens type is not limited thereto. Other lenses can be used based on application needs.

Figure 4:
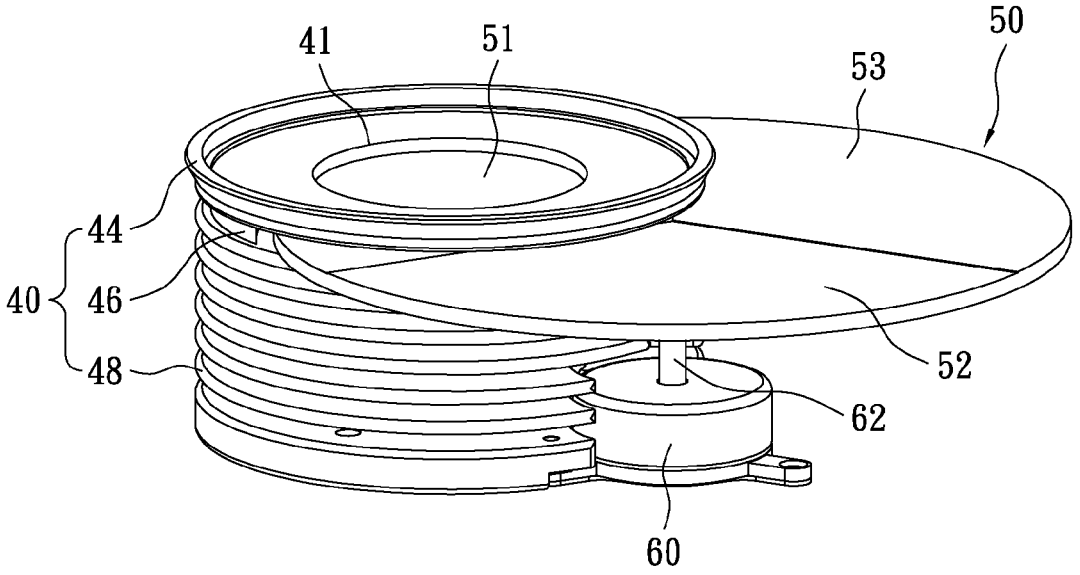
FIG. 4 is a perspective view of the lighting device, without the holder, cover, and lens.

Please refer to FIGS. 3 and 4. The optical color wheel 50 includes three color petals 51, 52, 53. The collar 55 is extended downward from the center of the bottom surface of the optical color wheel 50 and connects the optical color wheel 50 to the shaft 62 of the motor 60. The motor 60 can be remotely controlled or pre-programmed to spin the optical color wheel 50 axially. Thus, one of the three color petals 51, 52, 53 is arranged between the light source 70 and the lens 30. Thereby, light from the light source 70 passes through the color petal 51, 52, or 53 to produce light of different color temperatures. In FIG. 4, light pass through the color petal 51. Although the optical color wheel 50 has three color petals 51, 52, 53 for the instant disclosure, but are not limited thereto. Based on needs, the number and arrangement of the color petals can be varied. Please refer back to FIG. 2, wherein the motor 60 is secured to the base 40 by a shim 64 and a plurality of screws 66.

Please refer back to FIGS. 1 and 2, a base receiving portion 12 and an optical color wheel receiving portion 14 are formed on the holder 10. The optical color wheel receiving portion 14 is above the base receiving portion 12 and connected thereto, wherein the optical color wheel receiving portion 14 extends outward with a tongue-like shape. The base receiving portion 12 can receive the base 40 and the motor 60 mounted to the base 40. The optical color wheel receiving portion 14 can receive the optical color wheel 50. A plurality of evenly spaced vents 16 are formed on the base receiving portion 12 corresponding to the fins 48. The vents 16 are narrow and long openings, whose longitudinal directions are parallel to a central axis of the body 42. Ambient air can enter through the vents 16, travel between the fins 48, and generate heat convection effect to improve heat dissipation rate for the base 40.

The cover 20 includes a mating portion 22 and a covering portion 24. The mating portion 22 is ring-shaped and connects to the covering portion 24. The mating portion 22 can be removably attached to the base 40. In other words, the mating portion 22 has a ring-like structure for mating to an outer periphery of the base 40. More specifically, the mating portion 22 is mated to the outer periphery of the support portion 44 of the base 40. The covering portion 24 extends outwardly from the periphery of the mating portion 22, having an arched shape to cover a section of the optical color wheel 50 (section not at the base 40). When the mating portion 22 is mated to the support portion 44, the covering portion 24 covers the optical color wheel 50 for protection.

The light source 70 may include a plurality of light-emitting diodes (LED) 72 and a circuit board 74. The LEDs 72 are disposed on the circuit board 74 by the method of surface mount technology (SMT). The circuit board 74 is disposed on the bottom board of the body 42 of the base 40.

For the lighting device of the instant disclosure, the optical color wheel can establish thermal contact with the base. Thus, asides from heat dissipation for the light source by the fins of the base, heat due to light reacting with the optical color wheel can also be dissipated. In addition, since the lens is movably disposed on the base, the projection angle or light shape can be adjusted accordingly. The optical color wheel can be spun and include a plurality of color petals. By spinning the optical color wheel, the light pass through different color petals to provide multiple colors of light. Thus, the color temperature of the light of the lighting device can be adjusted.

The descriptions illustrated supra set forth simply the preferred embodiment of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An LED illumination device, comprising:

a base including:

a body having a circular upper open end and a circular bottom end arranged along a longitudinal axis of the body, having a plurality of fins extended from an outer surface thereof;

a support portion arranged around the circular upper open end of the body and perpendicular to the longitudinal axis of the body; and a connecting portion connecting the body and the support portion partially;

an LED light source disposed on the bottom end of the body of the base;

an optical color wheel, a part of the optical color wheel received within the connecting portion of the base and the optical color wheel directly disposed above the LED light source, and a top surface of the optical color wheel rotatably contacted with a bottom surface of the support portion of the base;

thereby heat generated from the optical color wheel is conducted to the fins of the base by physically contacting the top surface of the optical color wheel with the bottom surface of the support portion, light form the LED light source passing through the optical color wheel and being converted to a colored light;

a motor arranged outside of the base, wherein the motor has a shaft connected to the optical color wheel and rotated to spin the optical color wheel axially in contact with the support portion of the base;

a lens disposed on the support portion of the base; and a holder having a base receiving portion for receiving the base therein and an optical color wheel receiving portion for receiving a part of the optical color wheel therein, wherein the optical color wheel receiving portion is above the base receiving portion and extended outwardly from the base receiving portion;

wherein the base, the optical color wheel and the motor are received in the holder;

wherein the colored light passed through the lens to form a light beam, and wherein heat generated by the light source and the optical color wheel are conducted to the fins by physically contacting with the base for dissipating thereby.

2. The LED illumination device of claim 1, wherein a clearance is formed by the connecting portion between the body and the support portion to receive the optical color wheel thereinside.

3. The LED illumination device of claim 1, further comprising a heat conducting material coated on the bottom surface of the support portion to enhance heat dissipation.

4. The LED illumination device of claim 1, wherein the body is a hollow cylinder shaped with a bottom board, and the fins are parallel to the bottom board of the body and formed a plurality of annular structures parallel to each other on the outer surface of the body.

5. The LED illumination device of claim 1, wherein an opening is formed centrally on the support portion for providing passage to the light emitted from the light source, and a central point of the opening is located on an optical axis defined by the lens.

6. The LED illumination device of claim 5, further comprising a lens holder disposed correspondingly to the opening and holding the lens, and the lens holder being held up by the supporting portion, wherein the support portion has a first threaded portion, the lens holder has a second threaded portion, the lens is moved along the optical axis by threading the second thread portion into the first threaded portion or threading the second thread portion away from the first threaded portion.

7. The LED illumination device of claim 1, wherein the optical color wheel has a plurality of color petals, one of the color petals being rotatably disposed between the light source and the lens, and wherein the light of the light source pass through one of the color petals to produce the colored light.

8. The LED illumination device of claim 1, wherein a recess is formed on a portion of the fins to receive the motor, the motor being mounted thereinside.

9. The LED illumination device of claim 8, wherein the recess is formed on the portion of the fins in approximately corresponding to the connecting portion to receive the motor such that the connecting portion and the motor are arranged on opposing sides of the base.

10. The LED illumination device of claim 1, further comprising a motor having a shaft, the shaft being connected to the optical color wheel and being rotated to spin the optical color wheel axially in contact with the base.

11. The LED illumination device of claim 10, wherein a recess is formed on a portion of the fins to receive the motor, the motor being mounted thereinside.

12. The LED illumination device of claim 10, further comprising a heat conducting material coated on the base, the shaft of the motor being rotated to spin the optical color wheel axially in contact with the heat conducting material for enhancing the heat dissipation.

13. The LED illumination device of claim 1, wherein a plurality of vents are spaced evenly on the base receiving portion corresponding to the fins, the vents being narrow and long.

14. The LED illumination device of claim 13, wherein longitudinal directions of the vents are parallel to a central axis of the base.

15. The LED illumination device of claim 13, further comprising a cover having a mating portion and a covering portion, the mating portion mating to an outer periphery of the base, the covering portion extending from the mating portion for covering a portion of the optical color wheel, the holder being covered by the cover.

16. The LED illumination device of claim 1, further comprising a cover having a mating portion and a covering portion, the mating portion has a ring-like structure for mating to an outer periphery of the base, the covering portion having an arched shape and extending from the mating portion for covering a portion of the optical color wheel.

17. The LED illumination device of claim 1, further comprising a wavelength conversion material coated on the optical color wheel, wherein the light emitted by the light source excites the wavelength conversion material to generate the colored light.

* * * * *